US006244342B1

(12) United States Patent
Sullaway et al.

(10) Patent No.: US 6,244,342 B1
(45) Date of Patent: Jun. 12, 2001

(54) REVERSE-CEMENTING METHOD AND APPARATUS

(75) Inventors: Bobby L. Sullaway; David D. Szarka, both of Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/388,018

(22) Filed: Sep. 1, 1999

(51) Int. Cl.[7] ..... E21B 34/00
(52) U.S. Cl. ..... 166/285; 166/318; 166/332.4
(58) Field of Search ..... 166/285, 242.8, 166/323, 291, 293, 156, 283, 317, 318, 319, 332.1, 332.4

(56) References Cited

U.S. PATENT DOCUMENTS

| | | | | |
|---|---|---|---|---|
| 3,730,267 | * | 5/1973 | Scott | 166/335 |
| 3,768,562 | * | 10/1973 | Baker | 166/289 |
| 3,776,250 | * | 12/1973 | Knox | 137/71 |
| 3,948,322 | * | 4/1976 | Baker | 166/289 |
| 5,472,053 | | 12/1995 | Sullaway et al. . | |
| 5,494,107 | * | 2/1996 | Bode | 166/285 |
| 5,890,538 | * | 4/1999 | Beirute et al. | 166/285 |

OTHER PUBLICATIONS

SPE Paper 25440 entitled "Reverse Circulation Of Cement On Primary Jobs Increase Cement Column Height Across Weak Formation" by J.E. Griffith, D.Q. Nix and G.A. Boe, presented at the Production Operation Symposium held in Oklahoma City, OK., Mar. 21—23, 1993.

Journal of Petroleum Technology article titled "Primary Cementing By Reverse Circulation Solves Critical Problem In The North Hassi–Messaoud Field, Algeria" by R. Marquaire and J. Brisac, Feb. 1966, pp. 146–150.

* cited by examiner

*Primary Examiner*—Frank S. Tsay
(74) *Attorney, Agent, or Firm*—Craig W. Roddy; Anthony L. Rahhal

(57) ABSTRACT

The present invention relates to reverse-cementing apparatus. The reverse-cementing apparatus is a float apparatus connected in a pipe string to be cemented into a wellbore. The float apparatus includes an outer housing connected to the casing string. A check valve for preventing flow from the wellbore into the pipe string is disposed in the housing. The check valve is releasably disposed in the housing so that it can be removed from the housing once the pipe string is in place. A flow path for fluid from the wellbore into the pipe string is therefore provided. Cement displaced into the annulus will cause fluid in the wellbore to enter the pipe string through the housing so that the pipe string can be cemented in place utilizing a reverse-cementing method.

33 Claims, 11 Drawing Sheets

REVERSE-CEMENTING METHOD AND APPARATUS

BACKGROUND OF THE INVENTION

This invention relates to apparatus and methods for performing reverse-cementing operations. More particularly, this invention relates to apparatus for use in performing reverse-cementing operations.

Typically, after a well for the production of oil and/or gas has been drilled, casing is lowered into and cemented in the well. Normal primary cementing of the casing string in the wellbore includes lowering the casing to a desired depth and displacing a desired volume of cement down the inner diameter of the casing. Cement is displaced downward into the casing until it exits the bottom of the casing into the annular space between the outer diameter of the casing and the wellbore apparatus.

The casing may also be cemented into a wellbore by utilizing what is known as a reverse-cementing method. The reverse-cementing method comprises displacing conventionally mixed cement into the annulus between the casing string and the annulus between an existing string, or an open hole section of the wellbore. As the cement is pumped down the annular space, drilling fluids ahead of the cement are displaced around the lower ends of the casing string and up the inner diameter of the casing string and out at the surface. The fluids ahead of the cement may also be displaced upwardly through a work string that has been run into the inner diameter of the casing string and sealed off at its lower end. Because the work string has a smaller inner diameter, fluid velocities in the work string will be higher and will more efficiently transfer the cuttings washed out of the annulus during cementing operations. To insure that a good quality cement job has been performed, a small amount of cement will be pumped into the casing and the work string. As soon as a desired amount of cement has been pumped into the annulus, the work string may be pulled out of its seal receptacle and excess cement that has entered the work string can be reverse-circulated out the lower end of the work string to the surface.

Reverse-cementing, as opposed to utilizing the conventional method, provides a number of advantages. For example, cement may be pumped until a good quality of cement is obtained at the casing shoe. Furthermore, cementing pressures are much lower than those experienced with conventional methods and cement introduced in the annulus free-falls down the annulus, producing little or no pressure on the formation. Oil and/or gas in the wellbore ahead of the cement may be bled off through the casing at the surface. Finally, when the reverse-cementing method is used, less fluid is required to be handled at the surface and cement retarders may be utilized more efficiently.

Although it is often desirable to utilize the reverse-cementing method, one disadvantage is that float shoes and float collars cannot be used since such float apparatus contains a back pressure check valve to prevent the flow of cement into the bottom of the casing string once the casing has reached its desired location. It is desirable, however, to use float apparatus for a number of reasons. Float apparatus prevents back flow of cement into the casing inner diameter after the cementing operations have been completed. Float apparatus also prevents oil and/or gas under high pressure from entering the inner diameter of the casing as the casing string is being run into the wellbore. If gas or oil under high pressure does enter the wellbore, it can often result in a well blowout. Additionally, the weight of the casing, particularly with deep wells often creates a tremendous amount of stress and strain on the equipment and on the casing. Float apparatus minimizes that stress as the casing is lowered into the wellbore. Thus, it is desirable to float apparatus when lowering a casing string into a wellbore, and it is also desirable to use reverse-cementing methods to cement the casing in place. The need therefore exists for float apparatus which will allow casing to be cemented utilizing a reverse-cementing method.

SUMMARY OF THE INVENTION

The present invention is directed to reverse-cementing methods and apparatus and more specifically is directed to a float apparatus for use in reverse-cementing. The reverse-cementing apparatus of the present invention includes a valve housing which is adapted to be connected in a casing or other pipe string that is to be cemented in a wellbore. A check valve is disposed in the valve housing for preventing the communication of fluid into the pipe string from the wellbore. The invention also includes a means for communicating fluid from the wellbore into the casing after the casing has been lowered to its desired location so that fluid from the wellbore will pass into the casing as cement is displaced into the annulus between the casing and the wellbore to cement the casing in place. The valve housing is comprised of an outer housing and an inner housing, wherein the inner housing is fixedly attached to the outer housing. The check valve may be releasably disposed in the housing and comprises the means for communicating. The check valve may be disconnected and released from the housing, and may be removed from the housing by allowing the check valve to drop to the bottom of the wellbore. Once the check valve is removed from the housing, fluid from the annulus is communicated into the casing through the housing as cement is displaced downwardly into the annulus.

The check valve includes a valve sleeve having a valve element disposed therein. The valve sleeve is releasably connected to the housing such that when the sleeve is disconnected, the sleeve and the element are removed from the housing thus providing a flow path for fluid from the wellbore into the casing string. The sleeve may have a seat defined at the upper end thereof for engaging a releasing ball that is displaced downwardly through the casing string. After the ball engages the valve sleeve, pressure above the releasing ball is increased to a preselected amount sufficient to cause the sleeve to disconnect from the housing and to be displaced out of the housing to provide the flow path such that fluid from the wellbore can enter the casing string. Other objects and advantages will be apparent from the description and the drawings set forth herein.

BRIEF DESCRIPTION OF THE DRAWINGS

FIG. 6 shows a cross section of an additional embodiment of a reverse-cementing apparatus of the present invention lowered into a wellbore.

FIG. 9 shows an additional embodiment of a reverse-cementing apparatus of the present invention disposed in a wellbore.

DETAILED DESCRIPTION OF A PREFERRED EMBODIMENT

Figure 1:
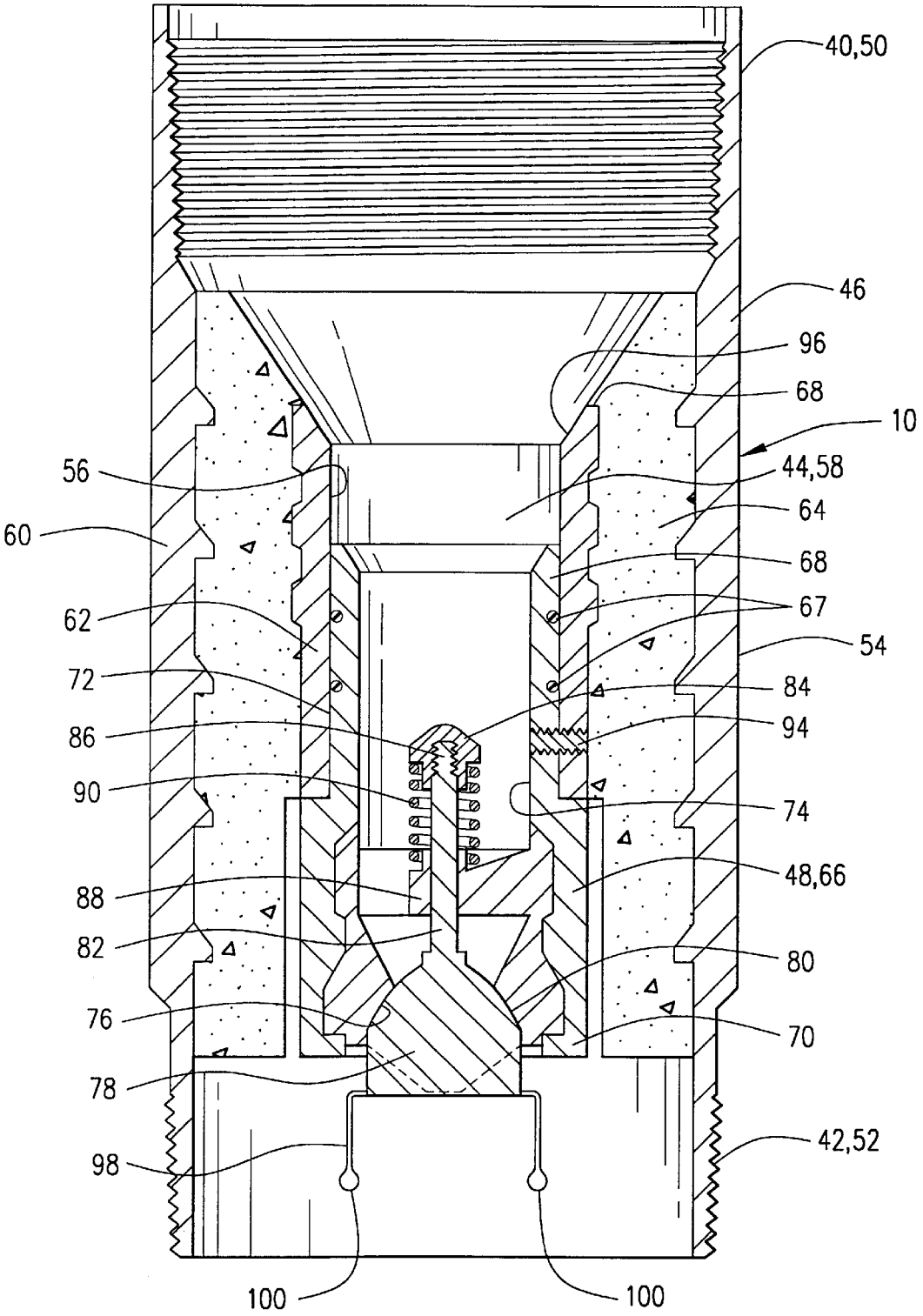
FIG. 1 is a cross-sectional view of an embodiment of the reverse-cementing apparatus of the present invention.
Figure 2:
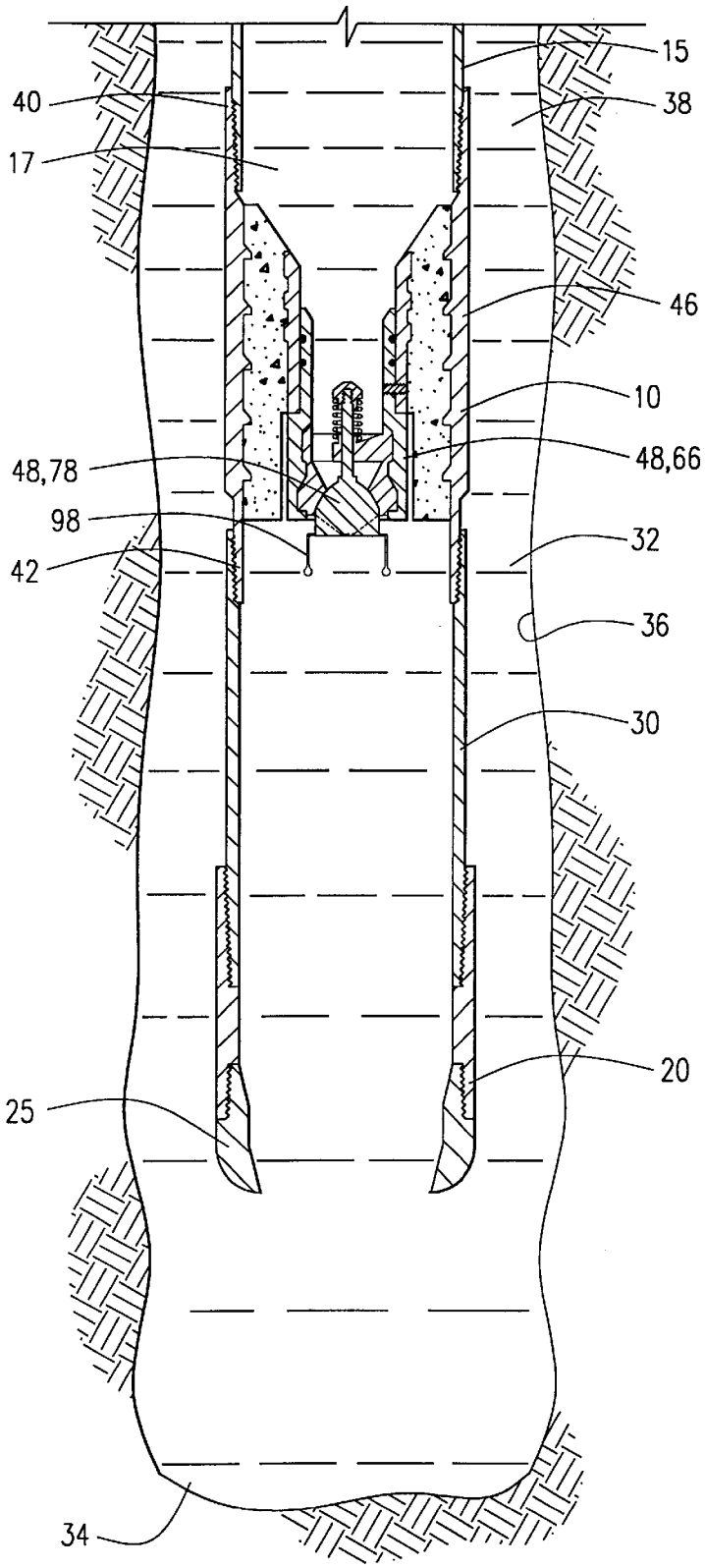
FIG. 2 is a cross-sectional view of the embodiment of FIG. 1 connected in a casing string and disposed in a wellbore.
Figure 3:
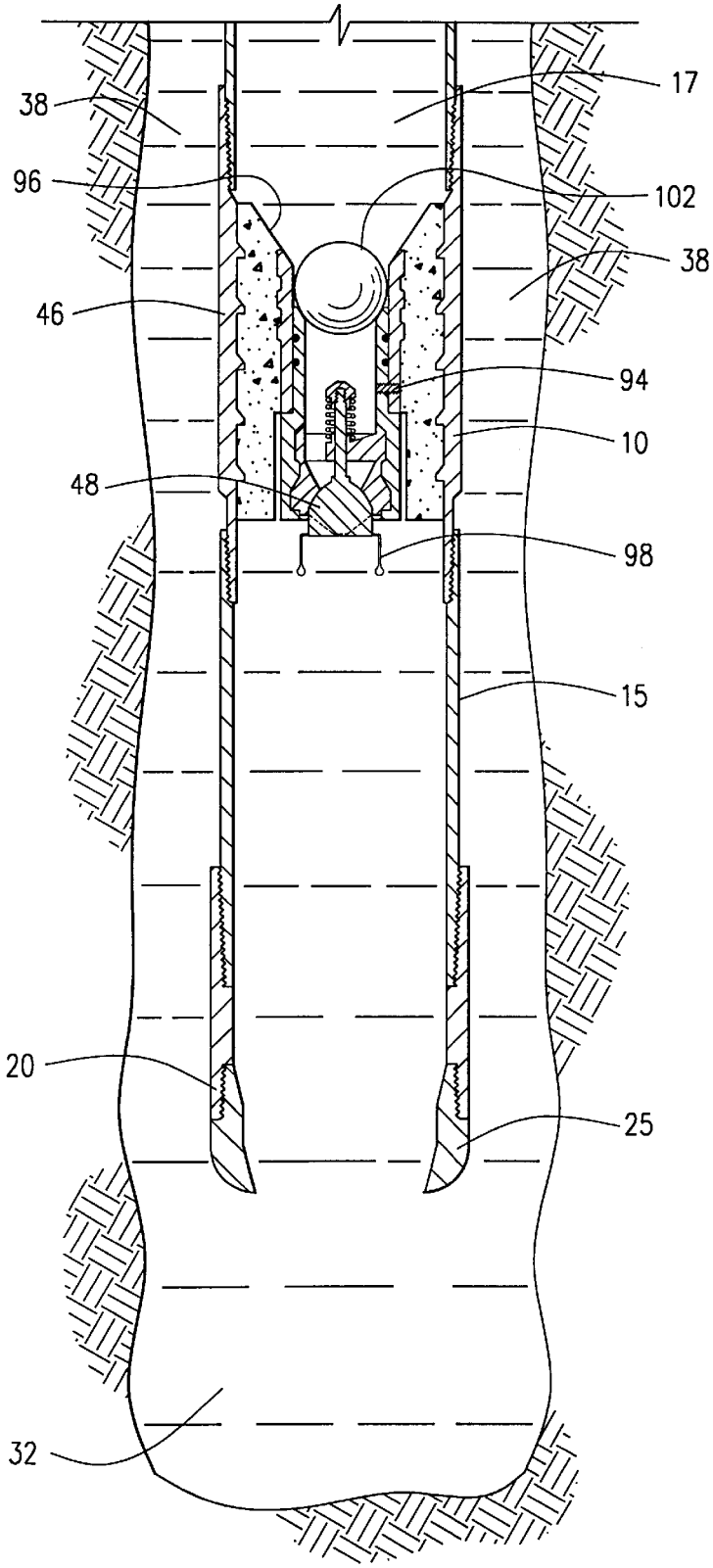
FIG. 3 shows the embodiment of FIG. 2 immediately prior to release of the check valve in the float apparatus.
Figure 4:
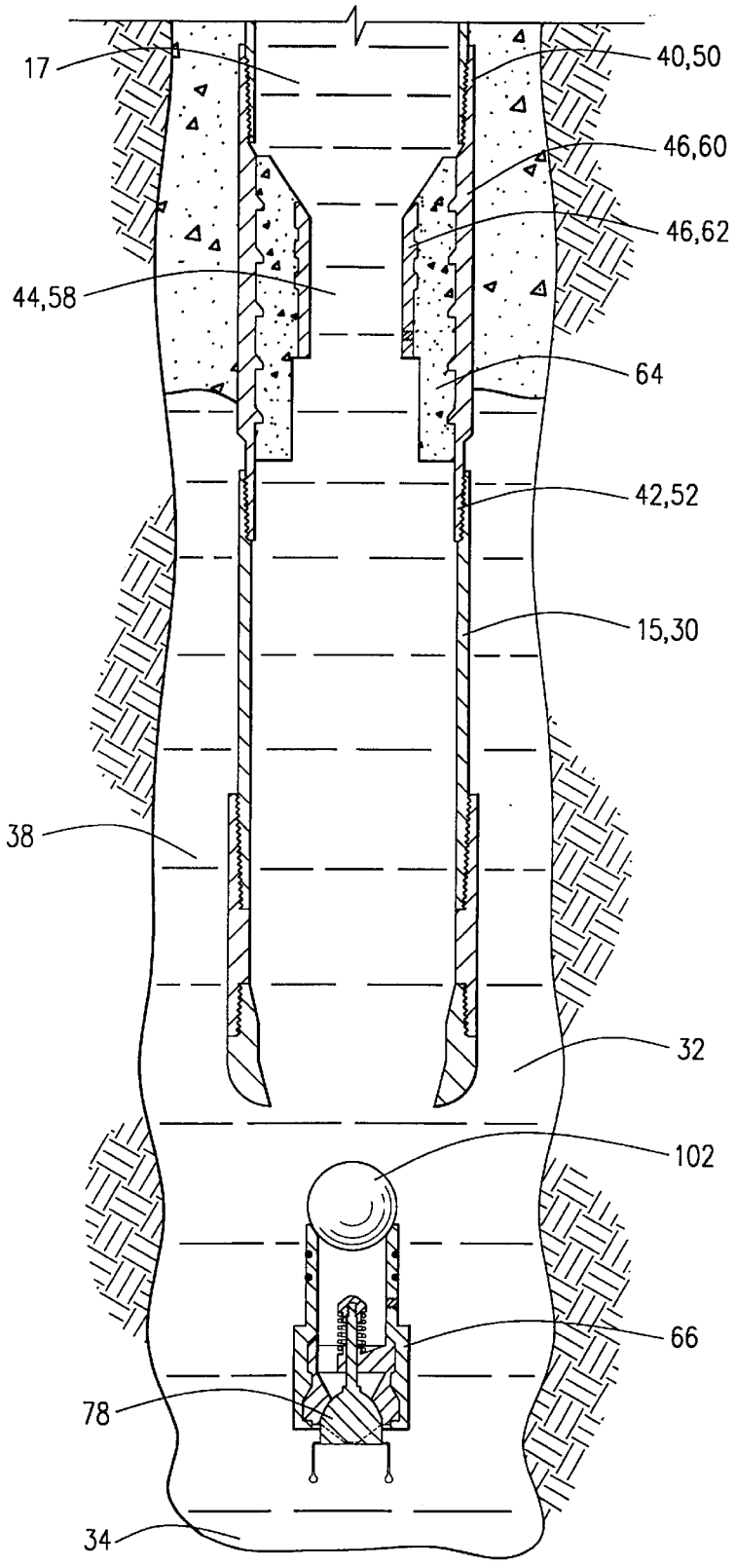
FIG. 4 shows the embodiment of FIG. 2 with the check valve released and dropped into the wellbore.

Referring now to the figures and more particularly to FIG. 1, a reverse-cementing apparatus for cementing a pipe string in a wellbore is shown and is designated by the numeral 10. Apparatus 10 is schematically shown connected in a pipe string 15 which may be a casing string, in FIGS. 2–5. Casing string 15 has an interior, or flow passage 17 which provides for the communication of fluids therethrough. Casing 15 has a lower end 20 which may have a guide shoe 25 attached thereto. Apparatus 10 may be threadedly connected to a shoe joint 30, which is in turn threadedly connected to guide shoe 25. Casing string 15 is lowered into a wellbore 32 having a bottom 34 and side 36. Casing string 15 and wellbore 32 define an annulus 38 therebetween. As depicted in FIG. 2, wellbore 32 and casing string 15 may be filled, or partially filled with a fluid, which may comprise a drilling fluid. As is apparent from the drawings, reverse-cementing apparatus 10 shown in FIGS. 1–5 is a float collar. However, the apparatus may be designed as a float shoe or other float apparatus as well.

Referring now back to FIG. 1, reverse-cementing apparatus 10 has an upper end 40, a lower end 42 and defines a longitudinal opening 44 therethrough. As depicted in FIG. 2, reverse-cementing apparatus 10, which may also be referred to as float collar 10, is threadedly connected at its upper and lower ends 40 and 42, respectively in casing string 15.

Apparatus 10 includes a valve housing or valve case 46 having a check valve 48 releasably connected therein. Valve housing 46 has upper and lower ends 50 and 52, an outer surface 54 and an inner surface 56. Valve housing 46 defines opening 58, which is communicated with an interior 17 of casing string 15 above apparatus 10.

Valve housing 46 includes an outer case or outer housing 60 and an inner case or inner housing 62. Outer case 60 is fixedly attached to inner case 62 with a body portion 64 which is typically comprised of a high compressive strength cement. Upper and lower ends 40 and 42 and outer surface 54 are defined by outer case 60. Inner surface 56 is defined by outer case 60, inner case 62 and body portion 64.

Check valve 48 which is preferably a poppet valve, may comprise a valve sleeve 66 releasably connected to valve housing 46. Valve sleeve 66 has an upper end 68, a lower end 70, an outer surface 72 and an inner surface 74. Valve sleeve 66 is sealingly received in inner case 62 and has a plurality of seals 67 disposed in the outer surface 72 thereof to sealingly engage inner surface 56 of housing 46. Inner surface 74 defines a valve seat 76 near the lower end 70 thereof.

Check valve 48 further comprises a valve element 78 adapted to be disposed in valve sleeve 66. Valve element 78 defines a sealing surface 80, which engages valve seat 76 to prevent flow into casing string 15 from wellbore 32. Valve element 78 includes a valve stem 82 extending upwardly from sealing surface 80. A valve cap 84 is attached to an upper end 86 of valve stem 82. A valve guide 88 is disposed in valve sleeve 66 and slidingly receives valve stem 82. A biasing spring 90 is disposed between valve guide 88 and cap 84 and urges valve element 78 upwardly so that sealing surface 80 engages valve seat 76 to prevent flow from passing through lower end 42 of apparatus 10 into casing string 15 thereabove. Valve sleeve 66 is releasably connected to valve housing 46, and preferably to inner housing 62, with a shear pin 94, which extends from valve sleeve 66 into inner case 62. The upper end 68 of valve sleeve 66 defines a seat 96 for receiving a releasing ball.

Reverse-cementing operations utilizing the apparatus 10 of the present invention may be described with reference to FIGS. 2–5. FIG. 2 depicts a casing string 15, including the apparatus 10 of the present invention, lowered into wellbore 32. If desired, auto fill straps 98 may be utilized to allow the casing to fill slowly as it is lowered into the wellbore. Usage of the auto fill strap is well known in the art and simply requires placing beads 100 defined on auto fill strap 98 between valve seat 76 and sealing surface 80 thereby allowing fluid to flow into casing string 15 through the apparatus 10 as it is lowered into the wellbore 32. Once casing 15, or other pipe string, has been lowered into the wellbore to a desired location, fluid may be circulated down the interior casing string and out the lower end 25 thereof to circulate and prepare the wellbore for cementing operations. Once the wellbore has been prepared, biasing spring 90 will urge valve element 78 upwardly so that it sealingly engages valve seat 76 and prevents flow into casing string 15 through apparatus 10. In order to cement the casing string 15 in place utilizing a reverse-cementing method, a flow path for the fluid in the wellbore must be provided. The flow path is provided by releasing valve 48 from valve housing 46 and removing valve 48 therefrom by allowing it to fall to the bottom of wellbore 32.

Figure 5:
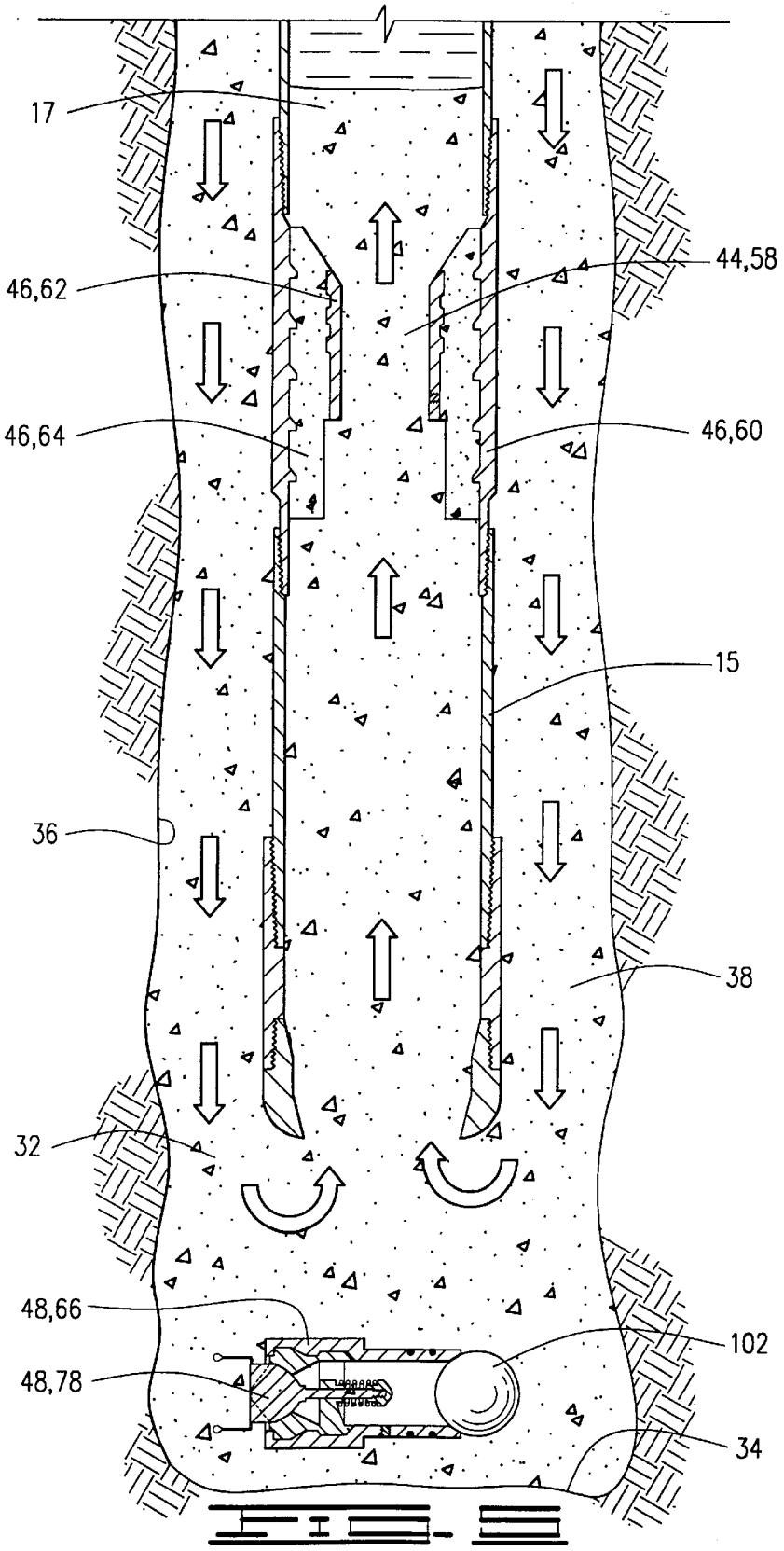
FIG. 5 shows the embodiment of FIG. 2 after reverse-cementing operations have occurred.
Figure 5:
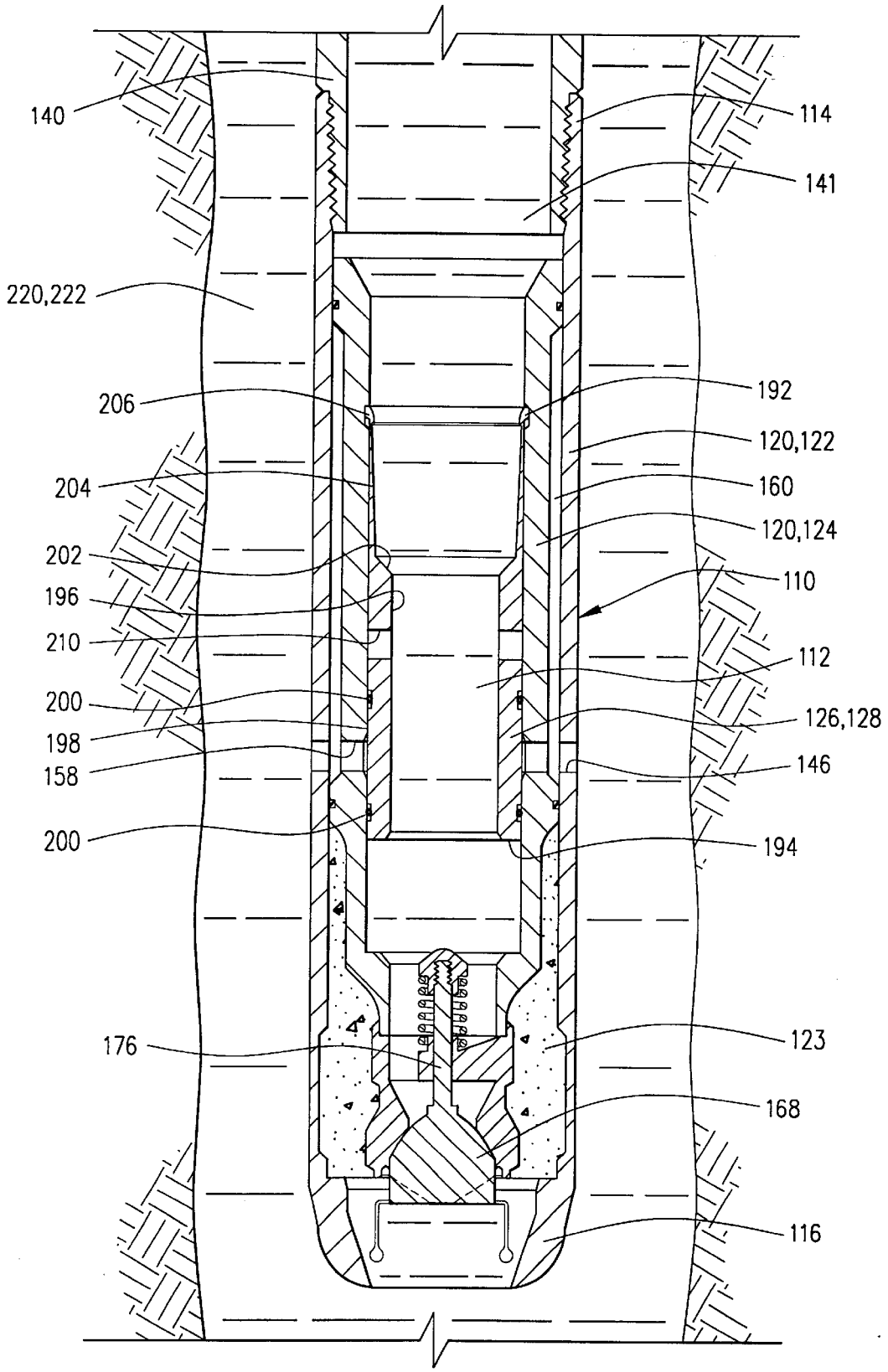

To disconnect, or release valve 48, a releasing ball 102 is displaced downward through casing string 15 until it engages seat 96. Pressure in the casing string above apparatus 10 is increased until shear pin 94 shears thus disconnecting and releasing valve 48, including sleeve 66 and element 78, from housing 46. Valve 48 is removed from housing 46 simply by allowing valve 48 to fall to bottom 34 of wellbore 32. Valve 48 is shown disconnected and removed from the casing string in FIGS. 4 and 5. Once valve 48 is removed, cement may be displaced downwardly in annulus 38. Fluid ahead of the cement displaced into annulus 38 will be forced downwardly around lower end 20 of casing string 15 and will flow upwardly through housing 46 into the portion of casing string 15 thereabove and to the surface. Cement is continually displaced into annulus 38 until a desired amount of cement has been displaced into the wellbore as schematically depicted in FIG. 5.

Figure 7:
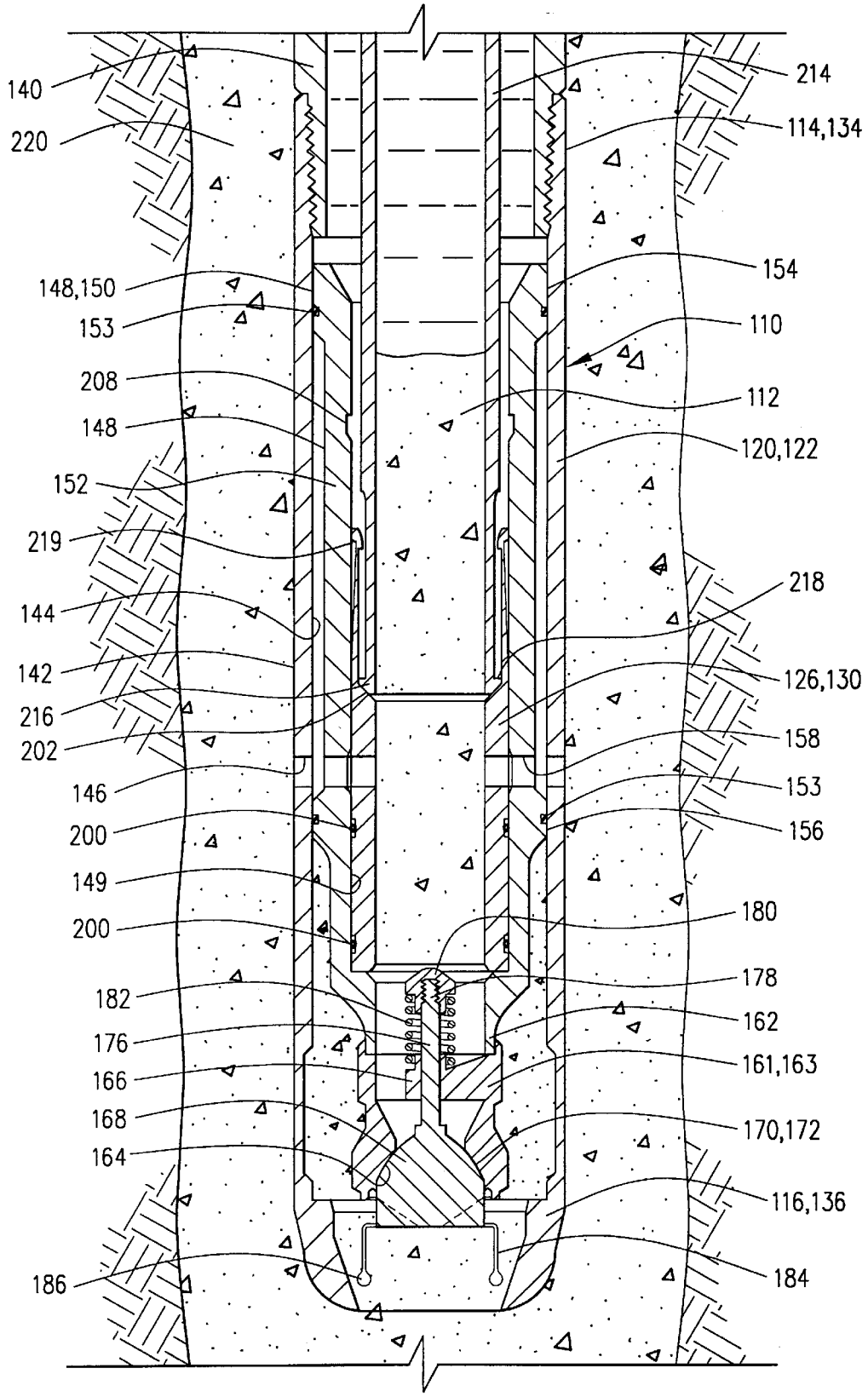
FIG. 7 is a cross section of the embodiment of FIG. 6 after reverse-cementing operations have begun.
Figure 8:
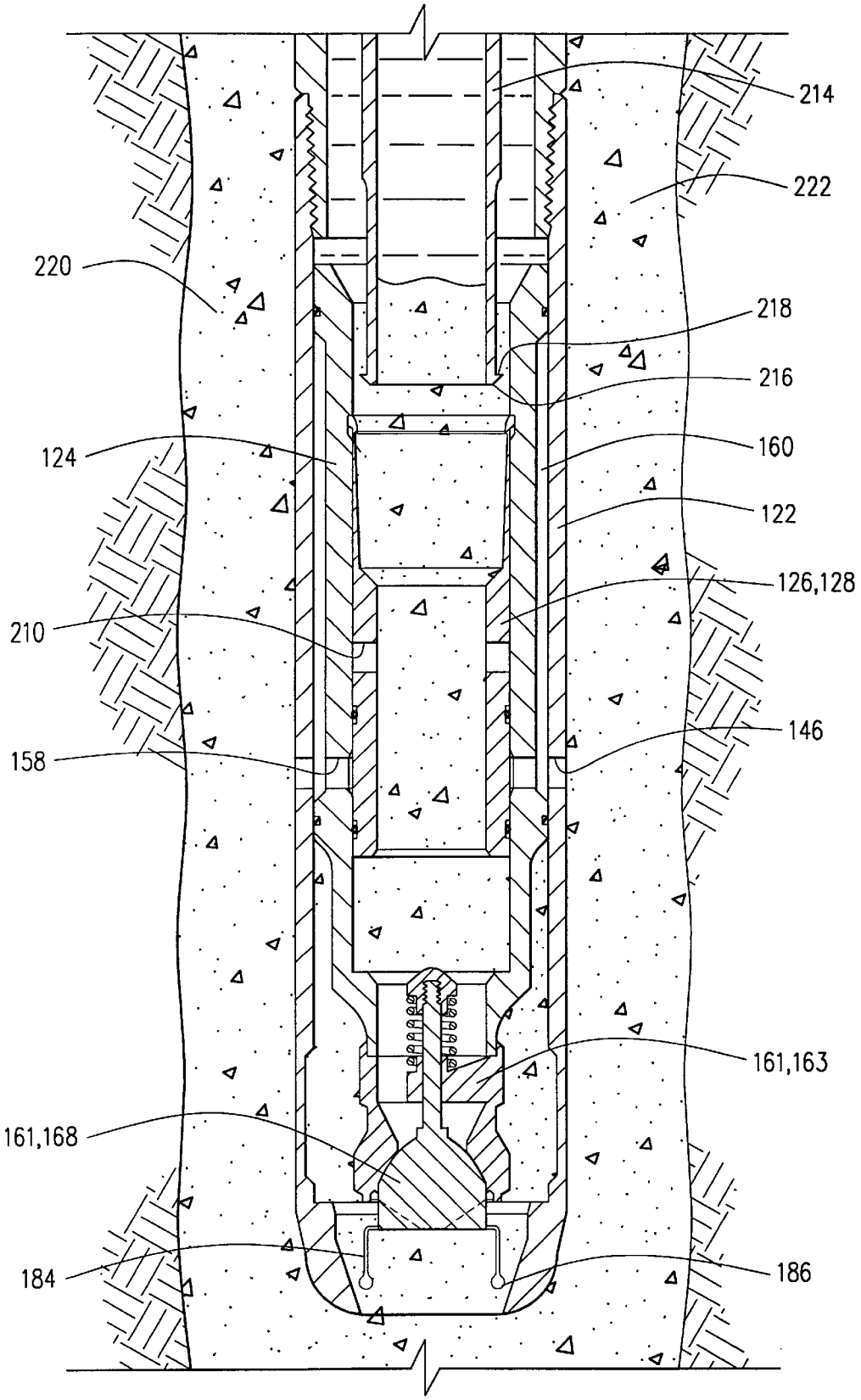
FIG. 8 shows the embodiment of FIG. 6 after a sufficient amount of cement has been displaced into the well and communication between the annulus and the casing string is prevented.
Figure 3:
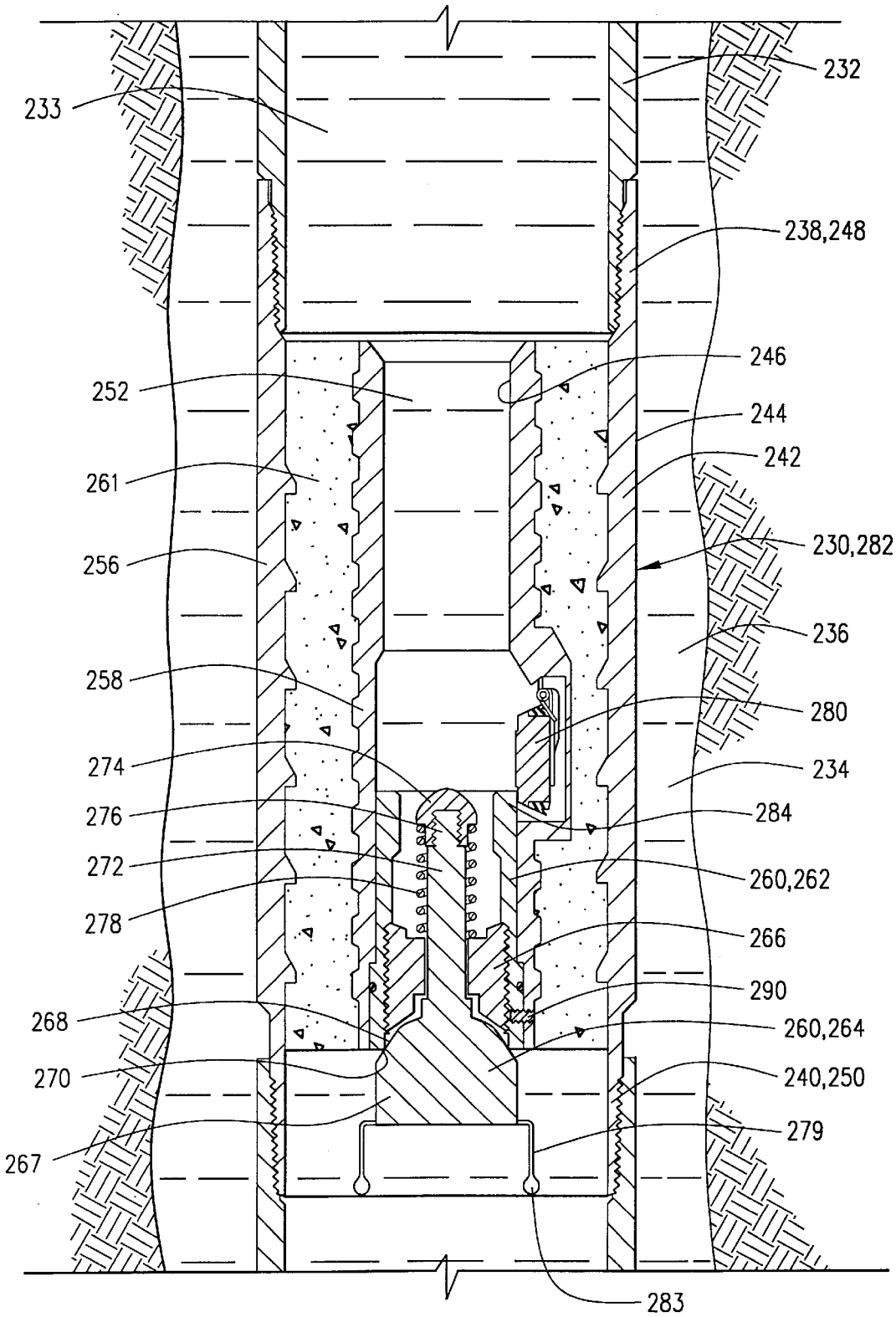

An additional embodiment of reverse-cementing apparatus, generally designated by the numeral 110 is shown in FIGS. 6–8. Reverse-cementing apparatus 110 is a float apparatus and in the embodiment shown is a float shoe 110. Reverse-cementing apparatus 110 defines a longitudinal opening 112 and has an upper end 114 and a lower end 116. Apparatus 110 comprises a valve housing or valve case 120 which includes an outer housing, or outer case 122, and an inner housing or inner case 124. Inner housing 124 is fixedly attached to outer housing 124 with body 123, which is preferably comprised of high compressive strength cement.

A slidable sleeve 126 is disposed in valve housing 120, preferably in inner housing 124, and is movable between a closed position 128 as depicted in FIG. 6 and an open position 130 as depicted in FIG. 7.

Outer housing 122 has an upper end 134 and a lower end 136. Outer housing 122 is threadedly connected at its upper end 134 to a pipe string 140, which may be a casing string 140. Casing string 140 defines an interior, or a flow passage 141, to provide for fluid flow therethrough. Upper and lower ends 134 and 136 comprise upper and lower ends 114 and 116 of reverse-cementing apparatus 110. Housing 122 has an outer surface 142 and an inner surface 144, and has a plurality of flow ports 146 extending therethrough.

Inner housing 124 has an outer surface 148 and an inner surface 149. Outer surface 148 defines a first outer diameter 150 and a second outer diameter 152. Seals 153 are disposed in outer surface 148 at first outer diameter 150. First outer diameter 150 thus sealingly engages the inner surface 144 of outer housing 122 above and below flow ports 146. Second outer diameter 152 is recessed inwardly from first outer diameter 150 so that first outer diameter 150 defines upper and lower shoulders 154 and 156 which sealingly engage housing 122.

A plurality of flow ports 158 are defined by inner housing 124 and are communicated with flow ports 146 and with an annular space 160 which is defined by and between the inner surface 144 of outer housing 122 and outer surface 148 of inner housing 124 between shoulders 154 and 156 respectively. A check valve 161 is disposed in valve housing 120, and is preferably attached to a lower end 162 of inner housing 124.

Valve 161, which is preferably a poppet valve, includes a valve sleeve 163 which defines a valve seat 164. Valve sleeve 163 also defines a valve guide 166, which extends inwardly into longitudinal opening 112. A valve element 168 is disposed in valve sleeve 163. Valve element 168 has a lower portion 170 defining a sealing surface 172. Sealing surface 172 is adapted to engage valve seat 164 to prevent flow through float apparatus 110 into interior 141 of casing string 140. A valve stem 176 extends upwardly from lower portion 170 to an upper end 178 of valve element 168. Valve stem 176 is received in valve guide 166. A valve cap 180 is connected to the upper end 178 of valve stem 176. A biasing spring 182 is disposed between valve cap 180 and valve guide 166 and urges valve element 168 upwardly so that sealing surface 172 will sealingly engage valve seat 164. Valve element 168 may also include an auto-fill strap 184 having beads 186 at the ends thereof.

Sliding sleeve 126 which is slidably disposed in inner housing 124 has an upper end 192, a lower end 194, an inner surface 196 and an outer surface 198. Sliding sleeve 190 is shown in closed position 128 in FIG. 6. Upper and lower seals 200 are disposed in outer surface 198 of sleeve 126 and sealingly engage inner surface 149 of inner housing 124 above and below flow ports 158 when sleeve 126 is in closed position 128. Inner surface 196 defines a seat 202 for engaging a lower end of a work string. A plurality of collet fingers 204 defined by sleeve 190 extends upwardly from seat 202. A plurality of collet heads 206 are defined at the upper end of collet fingers 204 and when sliding sleeve 126 is in closed position 128, collet heads 206 are received in a groove 208 defined by inner surface 149 of inner housing 124. A plurality of flow ports 210 extend through sleeve 194 and intersect longitudinal opening 112.

The operation of reverse-cementing apparatus 110 can be explained with reference to FIGS. 6–8. FIG. 6 shows the apparatus 110 being lowered into a wellbore 220. Auto-fill strap 184 may be utilized to allow circulation into the casing string as it is lowered into the wellbore. Once the casing string 140 has been lowered to its desired location, the well may be circulated and conditioned in a normal manner in preparation for cementing operations. Once bore 220 has been conditioned for cementing, a work string 214 having a lower end 216 may be lowered into casing string 140. Lower end 216 has an upward facing shoulder 218 defined thereon. Work string 214 is lowered until the lower end 216 thereof engages seat 202. Continued downward movement of work string 214 will cause collet fingers 204 to be urged radially inwardly so that collet heads 206 are removed from groove 208 and sliding sleeve 190 will move downwardly. Sliding sleeve 126 will move downwardly until flow ports 210 are communicated with flow ports 158 in inner housing 124, which are in communication with flow ports 146 in outer housing 122. Cement can then be displaced into an annulus 222 defined between casing string 140 and wellbore 220. Fluid in the annulus 222 will pass through ports 146, 158 and 210 into central opening 112 and upwardly into opening 141 as cement is displaced downwardly into annulus 222. Once a desired amount of cement has been displaced into annulus 222, work string 214 can be retracted. Upward-facing shoulder 218 defined by lower end 216 of work string 214 will engage a downward-facing shoulder 219 defined by collet heads 206. Thus, upward pull on work string 214 will cause sliding sleeve 126 to move upwardly into its closed position 128 from the open position 130 shown in FIG. 7. Sleeve 126 thus has an engagement means for engaging a lower end of a work string such that the work string can move the sleeve between its open and closed positions. Any cement in work string 214 can be reverse-circulated to the surface if desired. Back flow into the casing string is prevented by valve 161 in float apparatus 110.

Figure 10:
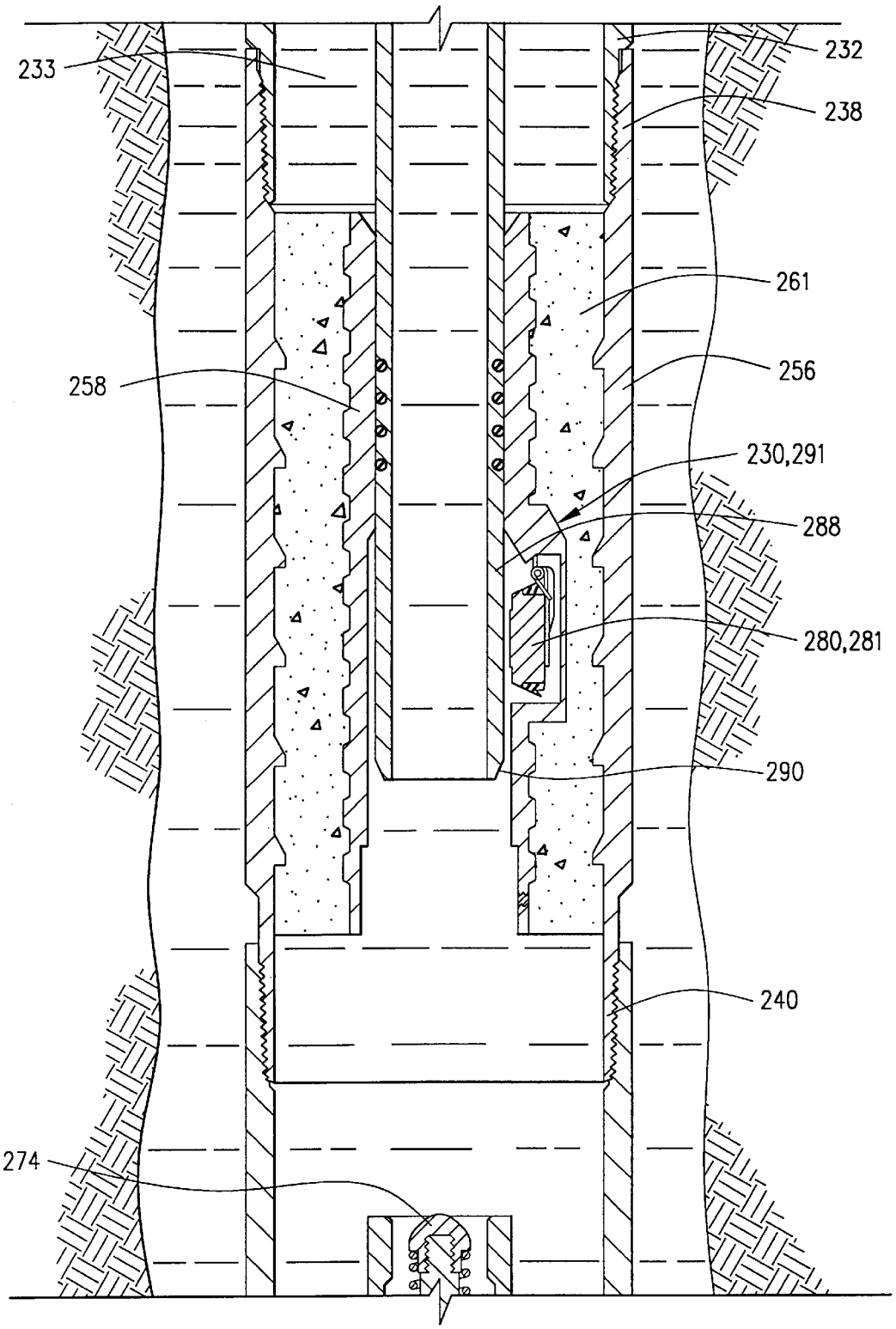
FIG. 10 shows the embodiment of FIG. 9 with a work string lowered into the casing string.
Figure 11:
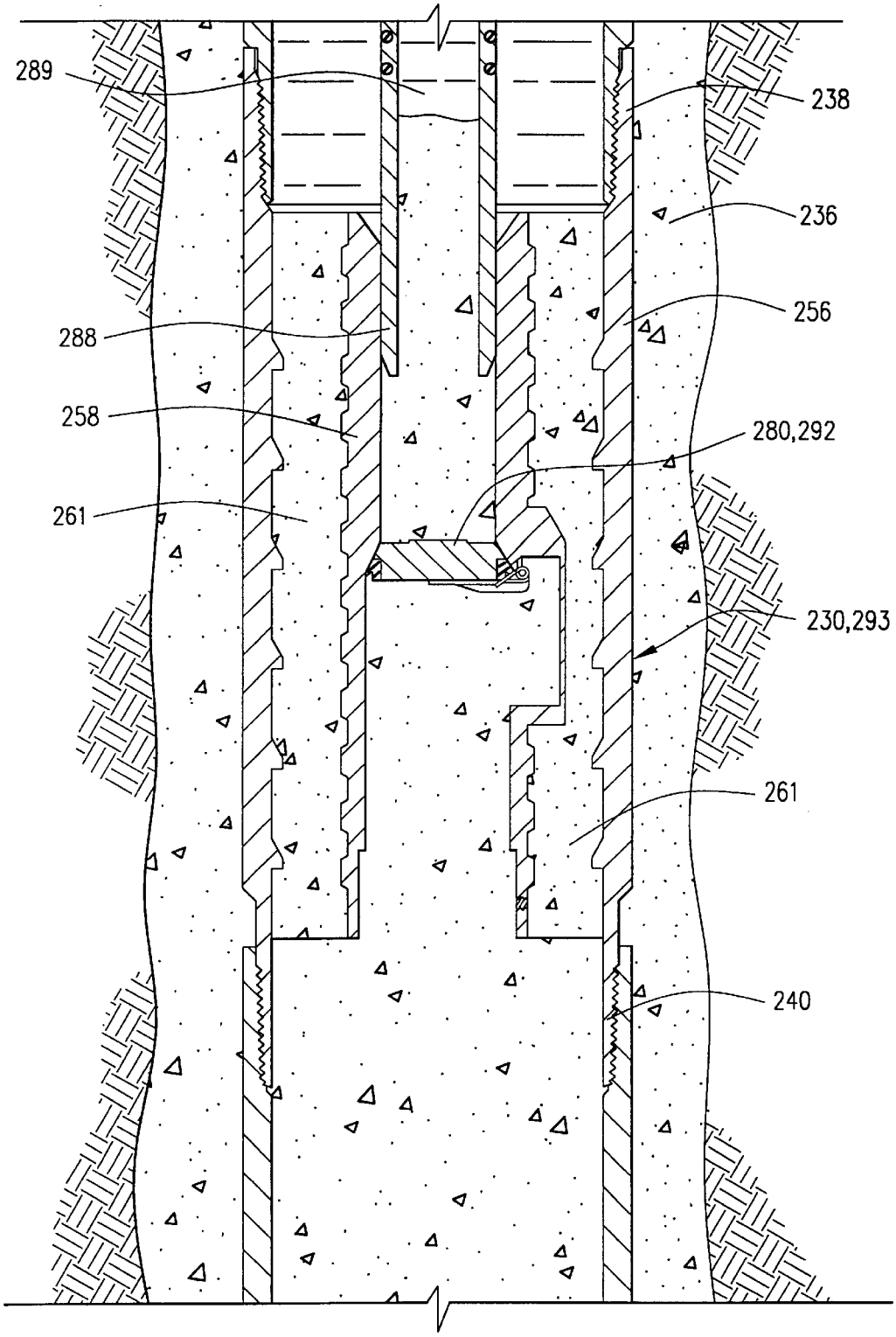
FIG. 11 shows the embodiment of FIG. 9 after the check valve in the reverse-cementing apparatus has been disconnected and the work string has been partially retracted.

A final embodiment of the reverse-cementing apparatus of the present invention is shown in FIGS. 9–11. Shown therein is a reverse-cementing apparatus 230 connected in a casing string 232 lowered into a wellbore 234. An annulus 236 is defined by and between casing string 232 and the side of wellbore 234. Casing string 232 has an interior, or longitudinal flow pressure 233 to provide for the flow of fluid therethrough. Reverse-cementing apparatus 230 comprises a float apparatus and, as shown in FIG. 9, preferably comprises a float collar 230.

Reverse-cementing apparatus 230 has an upper end 238 and a lower end 240. Upper and lower ends 238 and 240 threadedly connect apparatus 230 in casing string 232.

Reverse-cementing apparatus 230 comprises a valve housing or valve case 242 having an outer surface 244, an inner surface 246 and upper and lower ends 248 and 250. Housing 242 defines a longitudinal opening 252 communicated with longitudinal flow passage 233 of pipe string 232. Housing 242 comprises an outer case or outer housing 256 and an inner case or inner housing 258. Inner case 258 is connected to outer case 256 with a body portion 261 which is preferably comprised of a high compressive strength cement which fixedly connects inner and outer cases 256 and 258. A check valve 260 is disposed in housing 242, and is preferably releasably connected to inner case 258. Check valve 260 which may be referred to as a first check valve 260 and which is preferably a poppet valve, comprises a valve sleeve 262 having a valve element 264 disposed therein. Valve sleeve 262 includes a valve guide 266 threadedly connected therein. Valve element 264 has a lower portion 267 defining a sealing surface 268. Sealing surface 268 sealingly engages a valve seat 270 defined by valve sleeve 262. A valve stem 272 extends upwardly from lower portion 266 of valve element 264 and is received in valve guide 266. A valve cap 274 is connected to an upper end 276 of valve stem 272. A biasing spring 278 is disposed about valve stem 272 between cap 274 and valve guide 266 and urges sealing element 274 upwardly into sealing engagement with lower end 270 of valve sleeve 262. An auto-fill strap 279 having beads 283 at the ends thereof may be connected to lower portion 266 of sealing element 264.

A second check valve 280 is disposed in housing 242 and is preferably connected to inner case 258. Check valve 280 is preferably a flapper valve 280. Reverse-cementing apparatus 230 is shown in FIG. 9 in a closed position 282 after it has been lowered into wellbore 236. In closed position 282, apparatus 230 prevents communication of fluid from wellbore 234 into casing string 232. Auto-fill strap 278 can be utilized to allow flow into casing string 232 as it is lowered to the desired location in the wellbore. The wellbore can then be circulated through casing string 232 and prepared for cementing in the normal manner. Apparatus 230, when in closed position 282 prevents the flow of fluid through apparatus 230 into casing string 232 thereabove.

When float apparatus 230 is in closed position 282, an upper end 284 of valve sleeve 262 holds flapper valve 280 in its open position 281. Referring now to FIG. 10, a work string 288 may be lowered through casing string 232 so that it is sealingly received in inner case 258. Work string 288 has a lower end 290 adapted to engage upper end 284 of sleeve 262 and defines a flow passage, or interior 289. As work string 288 is urged downwardly, a shear pin 290, which releasably connects valve 260 to inner housing 258, will shear thus releasing valve 260 and removing it from the reverse-cementing apparatus 230 by allowing it to drop to the bottom of wellbore 234. FIG. 10 shows the apparatus after valve 260 has been engaged by work string 288 and is falling to the bottom of wellbore 234. Work string 288 will hold check valve 280 in its open position 281 so that apparatus 230 is in an open position 291 and reverse-cementing can begin. Cement may be displaced into annulus 236 between casing 232 and wellbore 234 and fluid in annulus 236 ahead of the cement will be communicated through the lower end of the casing string into flow passage, or interior 289 of work string 288. When the desired amount of cement has been displaced into wellbore 234, work string 288 may be retracted from inner case 258 which will allow flapper valve 280 to move to a closed position 292 to prevent back fill through reverse-cementing apparatus 230 which places apparatus 230 in a second closed position 293 to prevent backflow into casing string 232.

The embodiment of FIGS. 9–11 therefore has a first check valve 260, which comprises a poppet valve and a second check valve 280 which comprises a flapper valve disposed thereabove, and provides a float apparatus that can be utilized with reverse-cementing operations and can at the same time prevent back fill once reverse-cementing operations have been completed. After reverse-cementing operations have been completed, work string 288 may be withdrawn and any cement therein can be reverse-circulated to the surface. When a work string is utilized to communicate fluid ahead of the cement as described with reference to the embodiments shown in FIGS. 6–8 and 9–11, the velocity of the fluid is higher than the velocity of the fluid carried by the casing string, because of the smaller inner diameter. The high fluid velocity operates to effectively transfer cuttings washed out of the annulus during cementing operations.

It will be seen, therefore, that the reverse-cementing apparatus of the present invention and methods therefor are well adapted to carry out the ends and advantages mentioned as well as those inherent therein. While the presently preferred embodiments of the invention have been shown for purposes of this disclosure, numerous changes in the arrangement and construction of parts may be made by those skilled in the art. All such changes are encompassed within the scope and spirit of the dependent claims.

What is claimed is:

1. A reverse-cementing apparatus for cementing a pipe string in a wellbore, said pipe string and said wellbore defining an annulus therebetween, the reverse-cementing apparatus comprising:

a housing adapted to be connected to said pipe string; and a check valve disposed in said housing for preventing communication of fluid from said wellbore into said housing wherein said check valve is releasably disposed in said housing, so that said check valve may be removed from said housing and fluid from said annulus can be communicated into said pipe string through said housing as cement is displaced downwardly into said annulus to cement said pipe string in place.

2. A float apparatus for use in performing reverse-cementing operations to cement a pipe string in a wellbore, the float apparatus comprising:

an outer housing connected to said pipe string, said outer housing defining a flow port therethrough;

an inner housing sealingly disposed in said outer housing, said inner housing having a flow port defined therethrough communicated with said flow port in said outer housing;

a check valve disposed in said inner housing to prevent communication from said wellbore into said pipe string through said float apparatus; and a sleeve disposed in said inner housing, said sleeve being movable between an open position and a closed position, wherein in said open position said wellbore is communicated with said pipe string through said flow ports in said inner and outer housings, so that fluid in said wellbore can pass through said ports and into said pipe string as cement is displaced into an annulus defined by said wellbore and said pipe string to reverse cement said pipe string in said wellbore, and wherein in said closed position flow through said ports is blocked by said sleeve.

3. The apparatus of claim 2 wherein said sleeve defines a flow port therethrough, wherein in said open position said flow port in said sleeve is communicated with said flow ports in said inner and outer housings, and wherein in said closed position said flow ports in said sleeve are sealingly disposed in said inner housing.

4. The apparatus of claim 2, said sleeve defining an engagement means for engaging a lower end of a work string lowered through said pipe string into said float apparatus so that said work string may engage said sleeve and move said sleeve between its open and closed positions.

5. The apparatus of claim 4 said engagement means comprising spaced apart upward facing and downward facing shoulders defined by said sleeve, wherein said work string is selectively engagable with said shoulders so that said work string can move said sleeve vertically between its open and closed positions.

6. The apparatus of claim 5 wherein said lower end of said work string sealingly engages said sleeve when said work string moves said sleeve to said open position so that fluid in said wellbore will be communicated into said work string through said flow ports in said outer and inner housings and said sleeve as cement is displaced down said annulus.

7. The apparatus of claim 2, said float apparatus comprising a float shoe connected to a lower end of said pipe string.

8. A float apparatus for use in reverse-cementing a pipe string in a wellbore, the pipe string and the wellbore defining an annulus therebetween, said float apparatus comprising:

a valve housing adapted to be connected to said pipe string, said valve housing defining a longitudinal opening communicated with a flow passage defined by said pipe string thereabove; and a check valve releasably disposed in said valve housing, said check valve being adapted to prevent flow from said wellbore into said pipe string, wherein said check valve may be released from said valve housing and removed therefrom so that fluid may be communicated from said wellbore into said pipe string as cement is displaced into said annulus to cement said pipe string in said wellbore.

9. The apparatus of claim 8, said valve comprising a valve sleeve releasably connected to said valve housing and a valve element disposed in said valve sleeve.

10. The apparatus of claim 9, said sleeve defining a seat for receiving a releasing ball, wherein said check valve may be released and removed from said housing into said wellbore by displacing said releasing ball down said pipe string until it engages said seat and increasing pressure in said pipe string above said releasing ball to disconnect said sleeve from said valve housing.

11. The apparatus of claim 8, wherein said check valve comprises a poppet valve.

12. The apparatus of claim 8, said check valve of claim 8 comprising a first check valve, the apparatus further comprising a second check valve disposed in said housing, said second check valve having an open position wherein fluid may be communicated from said wellbore to said pipe string through said float apparatus, and a closed position wherein said second check valve prevents communication from said wellbore to said pipe string through said float apparatus after reverse-cementing operations are complete.

13. The apparatus of claim 12 wherein said first check valve is a poppet valve and wherein said second check valve is a flapper valve.

14. The float apparatus of claim 13 wherein said flapper valve is in said open position as said pipe string is lowered into said wellbore.

15. The float apparatus of claim 12, wherein a work string lowered into said pipe string will engage said first check valve to release said check valve from said housing.

16. The float apparatus of claim 15, wherein said work string holds said flapper valve in said open position as cement is displaced into said annulus so that fluid may be communicated upwardly through said housing and into said work string.

17. The float apparatus of claim 12, said valve housing comprising an outer housing and an inner housing, said inner housing being sealingly connected to said outer housing, said first and second check valves being connected to said inner housing.

18. A method of reverse-cementing a pipe string in a wellbore comprising:

lowering said pipe string into said wellbore to a desired location, said pipe string having a float apparatus connected therein;

communicating an interior of said pipe string with an annulus defined by said pipe string and said wellbore after said pipe string has been lowered to said desired location; and displacing cement downwardly into said annulus to cement said pipe string in said wellbore, wherein fluid in said annulus is communicated with said interior of said pipe string as said cement is displaced into said annulus.

19. The method of claim 18, wherein said float apparatus comprises:

a valve housing adapted to be connected to said pipe string; and a check valve disposed in said housing, wherein said communicating step comprises providing a flow path through said housing above said check valve to communicate fluid from said annulus with said an interior of said pipe string.

20. The method of claim 19, wherein, said valve housing comprises an inner and an outer housing each having flow ports defined therethrough, said inner housing having a sleeve slidably disposed therein, said communicating step comprising:

aligning said flow ports in said inner and outer housings with flow ports defined in said sleeve so that fluid may be communicated from said annulus into said interior of said pipe string therethrough.

21. The method of claim 20 wherein said aligning step comprises:

lowering a work string into said pipe string;

engaging said sleeve with said work string; and moving said sleeve with said work string to communicate said ports in said sleeve with said ports in said inner and outer housings.

22. The method of claim 18, further comprising:

lowering a work string into said pipe string; and communicating said fluid from said annulus into said work string through said float apparatus into said annulus as cement is displaced into said annulus.

23. The method of claim 18 said float apparatus comprising a valve housing connected to said pipe string, said valve housing having a check valve disposed therein, said communicating step comprising releasing said check valve from said valve housing and removing said check valve therefrom.

24. The method of claim 23 further comprising preventing flow from said wellbore into said pipe string through said float apparatus after a desired amount of cement has been displaced into said annulus.

25. A reverse-cementing apparatus for cementing a pipe string in a wellbore, said pipe string and said wellbore defining an annulus therebetween, the reverse-cementing apparatus comprising:

an outer housing adapted to be connected to said pipe string;

an inner housing disposed in said outer housing and fixedly attached thereto;

a first check valve disposed in said housing for preventing communication of fluid from said wellbore into said housing;

a second check valve disposed in said inner housing; and means for communicating fluid from said wellbore into said pipe string as cement is displaced downwardly into said annulus to cement said pipe string in place wherein said check valve comprises a poppet valve.

26. The apparatus of claim 25 said first check valve comprising a poppet valve removably disposed in said inner housing and said second check valve comprising a flapper valve connected to said inner housing, wherein said poppet valve may be disconnected from said housing so that fluid from said annulus may be communicated through said housing into said pipe string as cement is displaced down said annulus.

27. The apparatus of claim 26, said inner housing being adapted to receive a lower end of a work string lowered into said pipe string, wherein said lower end of said work string urges said poppet valve downwardly to disconnect said valve from said housing.

28. The apparatus of claim 26, said flapper valve having an open position and a closed position, wherein said flapper valve may be moved from said open position to said closed position to prevent flow upwardly through said housing into said pipe string after a desired amount of cement has been displaced into said annulus.

29. A reverse-cementing apparatus for cementing a pipe string in a wellbore, said pipe string and said wellbore defining an annulus therebetween, the reverse-cementing apparatus comprising:

an outer housing adapted to be connected to said pipe string;

an inner housing disposed in said outer housing and fixedly attached thereto;

a check valve disposed in said inner housing for preventing communication of fluid from said wellbore through said inner housing;

means for communicating fluid from said wellbore into said pipe string as cement is displaced downwardly into said annulus to cement said pipe string in place; and a sleeve disposed in said inner housing, said outer housing having a flow port defined therethrough communicated with a flow port defined through said inner housing, said means for communicating comprising a flow port defined in said sleeve, said sleeve being slidable between an open position and a closed position, wherein in said open position said annulus is communicated into said pipe string through said flow ports in said outer housing, said inner housing and said sleeve so that said fluid in said annulus is communicated into said pipe string through said ports as cement is displaced down said annulus, and wherein in said closed position said sleeve prevents communication between said pipe string and said annulus through said ports in said inner and outer housings.

30. The apparatus of claim 29, said sleeve being adapted to engage a work string lowered into said pipe string, wherein downward movement of said work string moves said sleeve into said open position so that fluid from said annulus may be communicated through said ports in said sleeve into said work string.

31. The apparatus of claim 30, wherein said work string will engage said sleeve so that upward movement of said work string will move said sleeve upwardly from said open position to said closed position.

32. The apparatus of claim 31, said work string being disengagable from said sleeve, wherein upward pull on said work string will cause said sleeve to be disengaged therefrom after said sleeve is moved to its closed position so that said work string can be removed and said sleeve stays in said closed position.

33. A reverse-cementing apparatus for cementing a pipe string in a wellbore, said pipe string and said wellbore defining an annulus therebetween, the reverse-cementing apparatus comprising:

a housing adapted to be connected to said pipe string;

a check valve disposed in said housing for preventing communication of fluid from said wellbore into said housing; and means for communicating fluid from said wellbore into said pipe string as cement is displaced downwardly into said annulus to cement said pipe string in place wherein said check valve comprises a poppet valve.

* * * * *